US008478464B2

(12) United States Patent
Arbuckle et al.

(10) Patent No.: US 8,478,464 B2
(45) Date of Patent: Jul. 2, 2013

(54) SYSTEMS AND METHODS FOR ORIENTING A MARINE VESSEL TO ENHANCE AVAILABLE THRUST

(75) Inventors: Jason S. Arbuckle, Horicon, WI (US); William R. Robertson, Oshkosh, WI (US); Kenneth G. Gable, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 401 days.

(21) Appl. No.: 12/881,956

(22) Filed: Sep. 14, 2010

(65) Prior Publication Data

US 2011/0153126 A1 Jun. 23, 2011

Related U.S. Application Data

(60) Provisional application No. 61/289,582, filed on Dec. 23, 2009.

(51) Int. Cl.
*B63H 25/42* (2006.01)

(52) U.S. Cl.
USPC ..... 701/21; 701/300; 114/144 B

(58) Field of Classification Search
USPC ..... 701/21, 300; 114/144 B, 144 C, 114/144 RE, 144 E; 440/53
See application file for complete search history.

(56) References Cited

U.S. PATENT DOCUMENTS

| | | | |
|---|---|---|---|
| 4,009,678 | A | 3/1977 | North |
| 4,220,111 | A | 9/1980 | Krautkremer et al. |
| 4,691,659 | A | 9/1987 | Ito et al. |
| 4,769,773 | A | 9/1988 | Shatto, Jr. |
| 5,031,561 | A | 7/1991 | Nilsson |
| 5,090,929 | A | 2/1992 | Rieben |
| 5,108,325 | A | 4/1992 | Livingston et al. |
| 5,386,368 | A | 1/1995 | Knight |
| 5,491,636 | A | 2/1996 | Robertson et al. |

(Continued)

FOREIGN PATENT DOCUMENTS

| | | | |
|---|---|---|---|
| DE | 906 907 | C | 3/1954 |
| EP | 0 423 901 | A1 | 4/1991 |

(Continued)

OTHER PUBLICATIONS

Peters et al., "A Feasible Concept of Bi-axial Controlled DP for FPSOs in Benign Environment", Sep. 2004, Dynamic Positioning Conference.*

(Continued)

*Primary Examiner* — Khoi Tran
*Assistant Examiner* — Spencer Patton
(74) *Attorney, Agent, or Firm* — Andrus, Sceales, Starke & Sawall, LLP

(57) ABSTRACT

Systems and methods for orienting a marine vessel enhance available thrust in a station keeping mode. A control device having a memory and a programmable circuit is programmed to control operation of a plurality of marine propulsion devices to maintain orientation of a marine vessel in a selected global position. The control device is programmed to calculate a direction of a resultant thrust vector associated with the plurality of marine propulsion devices that is necessary to maintain the vessel in the selected global position. The control device is programmed to control operation of the plurality of marine propulsion devices to change the actual heading of the marine vessel to align the actual heading with the thrust vector.

12 Claims, 12 Drawing Sheets

U.S. PATENT DOCUMENTS

| | | | | |
|---|---|---|---|---|
| 5,735,718 | A | 4/1998 | Ekwall | |
| 5,755,605 | A | 5/1998 | Asberg | |
| 6,142,841 | A | 11/2000 | Alexander, Jr. et al. | |
| 6,230,642 | B1 | 5/2001 | McKenney et al. | |
| 6,234,853 | B1 | 5/2001 | Lanyi et al. | |
| 6,357,375 | B1 | 3/2002 | Ellis | |
| 6,386,930 | B2 | 5/2002 | Moffet | |
| 6,431,928 | B1 | 8/2002 | Aarnivuo | |
| 6,447,349 | B1 | 9/2002 | Fadeley et al. | |
| 6,511,354 | B1 | 1/2003 | Gonring et al. | |
| 6,623,320 | B1 | 9/2003 | Hedlund | |
| 6,705,907 | B1 | 3/2004 | Hedlund | |
| 6,712,654 | B1 | 3/2004 | Putaansuu | |
| 7,305,928 | B2 | 12/2007 | Bradley et al. | |
| 2005/0016431 | A1 * | 1/2005 | Oma et al. | 114/230.1 |
| 2007/0089660 | A1 * | 4/2007 | Bradley et al. | 114/144 A |

FOREIGN PATENT DOCUMENTS

| | | | |
|---|---|---|---|
| JP | 58-61097 | A | 4/1983 |
| JP | 7-223591 | A | 8/1995 |
| JP | 2009-227035 | A | 10/2009 |
| JP | 2009-241738 | A | 10/2009 |
| WO | 2006/058400 | A1 | 6/2006 |

OTHER PUBLICATIONS

European Search Report for corresponding application EP 10252164.8, having a completion date of Oct. 25, 2012.

Strand, Jann Peter et al, Position Control Systems for Offshore Vessels; The Ocean Engineering Handbook, 2001.

* cited by examiner

SYSTEMS AND METHODS FOR ORIENTING A MARINE VESSEL TO ENHANCE AVAILABLE THRUST

CROSS-REFERENCE TO RELATED APPLICATION

The present application claims priority to U.S. Provisional Patent Application No. 61/289,582, which is incorporated herein in entirety by reference.

FIELD

The present disclosure relates generally to systems and methods for orienting a marine vessel.

BACKGROUND

Bradley et al U.S. Pat. No. 7,305,928 discloses vessel positioning systems that maneuver a marine vessel in such a way that the vessel maintains its global position and heading in accordance with a desired position and heading selected by the operator of the marine vessel. When used in conjunction with a joystick, the operator of the marine vessel can place the system in a station keeping-enabled mode and the system then maintains the desired position obtained upon the initial change in the joystick from an active mode to an inactive mode. In this way, the operator can selectively maneuver the marine vessel manually and, when the joystick is released, the vessel will maintain the position in which it was at the instant the operator stopped maneuvering it with the joystick.

SUMMARY

The present inventors have recognized that the amount of available thrust for positioning the vessel varies as the system carries out the station keeping functionality described above. For example, the available thrust to move the vessel sideways is necessarily less than the available thrust to move the vessel forward. This difference is because (1) propulsion devices such as propeller drives are more efficient while rotating in a forward direction than in a reverse direction and (2) propulsion devices will be more efficient when aligned in the direction of movement of the vessel than when aligned to achieve motion transverse to the actual heading of the vessel. That is, vectoring of the propeller devices to achieve for example side directed forces reduces the available thrust in the actual direction of vessel movement.

The present disclosure provides embodiments that maneuver a marine vessel to enhance available thrust and thus provide improved performance in station keeping modes. In one example, a system for orienting a marine vessel includes a plurality of marine propulsion devices for orienting a marine vessel; and a control device having a memory and a programmable circuit, the control device programmed to control operation of the plurality of marine propulsion devices to maintain orientation of a marine vessel in a selected global position. The control device is programmed to calculate a direction of a resultant thrust vector associated with the plurality of marine propulsion devices that is necessary to maintain the vessel in the selected global position. The control device is further programmed to control operation of the plurality of marine propulsion devices to change the actual heading of the marine vessel to align the actual heading with the thrust vector.

In another example, a method for orienting a marine vessel includes providing a plurality of marine propulsion devices coupled to the marine vessel; selecting a global position of the marine vessel; determining an actual heading of the marine vessel in the global position; and providing a control device having a memory and a programmable circuit, wherein the control device controls operation of the plurality of marine propulsion devices; and operating the control device to (a) control operation of the plurality of marine propulsion devices to maintain the global position of the marine vessel; (b) calculate a direction of a thrust vector associated with the plurality of marine propulsion devices, which is necessary to maintain the global position of the marine vessel; and (c) control operation of the plurality of marine propulsion devices to change the actual heading of the marine vessel to align the direction of the thrust vector and the actual heading.

In another example, a system for orienting a marine vessel includes a plurality of marine propulsion devices for orienting a marine vessel; control means for maintaining orientation of a marine vessel in a selected global position; control means for calculating a direction of a resultant thrust vector associated with the plurality of marine propulsion devices that is necessary to maintain the vessel in the selected global position; and control means for controlling operation of the plurality of marine propulsion devices to change the actual heading of the marine vessel to align the actual heading with the thrust vector.

DETAILED DESCRIPTION OF THE DRAWINGS

Figure 2:
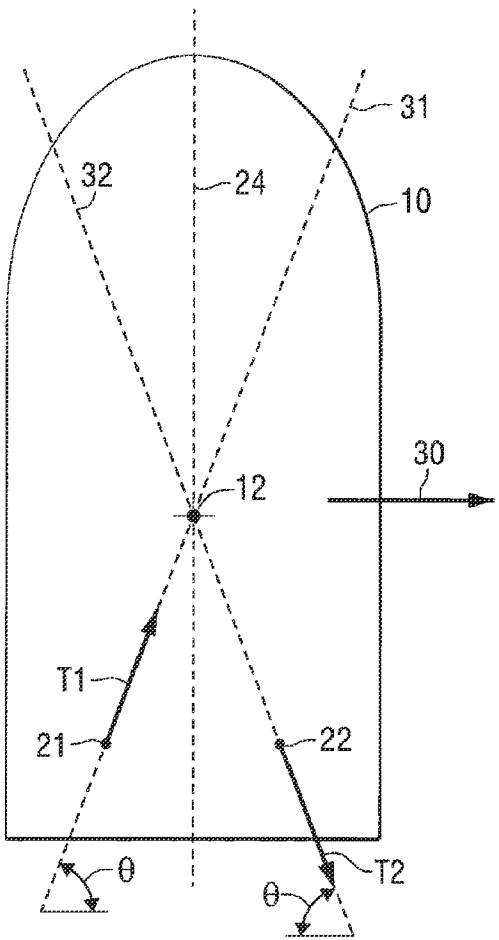
FIGS. 2 and 3 illustrate the arrangement of thrust vectors during a sidle movement of the marine vessel.

In the present description, certain terms have been used for brevity, clearness and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. §112, sixth paragraph only if the terms "means for" or "step for" are explicitly recited in the respective limitation.

Throughout the description of the preferred embodiments, like components will be identified by like reference numerals.

Drawing FIGS. 1-16 schematically depict various embodiments of marine vessels and control systems for orienting and maneuvering the marine vessels. It should be understood that the particular configurations of the marine vessels and control systems shown and described are exemplary. It is possible to apply the concepts described in the present disclosure with substantially different configurations for marine vessels and control systems therefor. For example, the marine vessels that are depicted in the drawing figures have first and second marine propulsion devices 27, 28 that have limited ranges or rotation. However, it should be understood that the concepts disclosed in the present disclosure are applicable to marine vessels having any number of marine propulsion devices and any configuration of a propulsion device, such as propeller, impeller, pod drive, and the like. In addition, the control systems described herein include certain operational structures such as global positioning system (GPS) devices and inertial measurement units (IMUs). It should be understood that the concepts disclosed in the present disclosure are capable of being implemented with different types of systems for acquiring global position data and are not limited to the specific types and numbers of such devices described and depicted herein. Further, the present disclosure describes certain types of user input devices such a joystick 52 and user input 120. It should also be recognized that the concepts disclosed in the present disclosure are also applicable in a preprogrammed format without user input, or in conjunction with different types of user input devices, as would be known to one of skill in the art. Further equivalents, alternatives and modifications are also possible as would be recognized by those skilled in the art.

Figure 1:
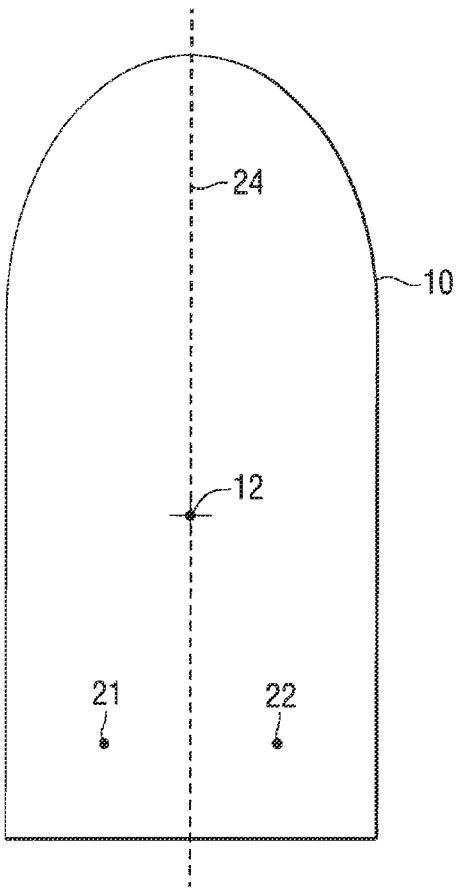
FIG. 1 is a highly schematic representation of a marine vessel showing the steering axes and center of gravity.

In FIG. 1, a marine vessel 10 is illustrated schematically with its center of gravity 12. First and second steering axes, 21 and 22, are illustrated to represent the location of first and second marine propulsion devices (reference numerals 27 and 28 in FIG. 9) located under the hull of the marine vessel 10. The first and second marine propulsion devices are rotatable about the first and second steering axes, 21 and 22, respectively. The first marine propulsion device, on the port side of a centerline 24, is configured to be rotatable 45 degrees in a clockwise direction, viewed from above the marine vessel 10, and 15 degrees in a counterclockwise direction. The second marine propulsion device, located on the starboard side of the centerline 24, is oppositely configured to rotate 15 degrees in a clockwise direction and 45 degrees in a counterclockwise direction. The ranges of rotation of the first and second marine propulsion devices are therefore symmetrical about the centerline 24 in a preferred embodiment.

The positioning method of the present disclosure rotates the first and second propulsion devices about their respective steering axes, 21 and 22, in an efficient manner that allows rapid and accurate maneuvering of the marine vessel 10. This efficient maneuvering of the first and second marine propulsion devices is particularly beneficial when the operator of the marine vessel 10 is docking the marine vessel or attempting to maneuver it in areas where obstacles exist, such as within a marina.

FIG. 2 illustrates one element of the present disclosure that is used when it is desired to move the marine vessel 10 in a direction represented by arrow 30. In other words, it represents the situation when the operator of the marine vessel wishes to cause it to sidle to the right with no movement in either a forward or reverse direction and no rotation about its center of gravity 12. This is done by rotating the first and second marine propulsion devices so that their thrust vectors, T1 and T2, are both aligned with the center of gravity 12. This provides no effective moment arm about the center of gravity 12 for the thrust vectors, T1 and T2, to exert a force that could otherwise cause the marine vessel 10 to rotate. As can be seen in FIG. 2, the first and second thrust vectors, T1 and T2, are in opposite directions and are equal in magnitude to each other. This creates no resultant forward or reverse force on the marine vessel 10. The first and second thrust vectors are directed along lines 31 and 32, respectively, which intersect at the center of gravity 12. As illustrated in FIG. 2, these two lines, 31 and 32, are positioned at angles theta. As such, the first and second marine propulsion devices are rotated symmetrically relative to the centerline 24. As will be described in greater detail below, the first and second thrust vectors, T1 and T2, can be resolved into components, parallel to centerline 24, that are calculated as a function of the sine of angle theta. These thrust components in a direction parallel to centerline 24 effectively cancel each other if the thrust vectors, T1 and T2, are equal to each other since the absolute magnitudes of the angles theta are equal to each other. Movement in the direction represented by arrow 30 results from the components of the first and second thrust vectors, T1 and T2, being resolved in a direction parallel to arrow 30 (i.e. perpendicular to centerline 24) as a function of the cosine of angle theta. These two resultant thrust components which are parallel to arrow 30 are additive. As described above, the moment about the center of gravity 12 is equal to zero because both thrust vectors, T1 and T2, pass through the center of gravity 12 and, as a result, have no moment arms about that point.

While it is recognized that many other positions of the thrust, T1 and T2, may result in the desired sidling represented by arrow 30, the direction of the thrust vectors in line with the center of gravity 12 of the marine vessel 10 is most effective and is easy to implement. It also minimizes the overall movement of the propulsion devices during complicated maneuvering of the marine vessel 10. Its effectiveness results from the fact that the magnitudes of the first and second thrusts need not be perfectly balanced in order to avoid the undesirable rotation of the marine vessel 10. Although a general balancing of the magnitudes of the first and second thrusts is necessary to avoid the undesirable forward or reverse movement, no rotation about the center of gravity 12 will occur as long as the thrusts are directed along lines, 31 and 32, which intersect at the center of gravity 12 as illustrated in FIG. 2.

Figure 3:
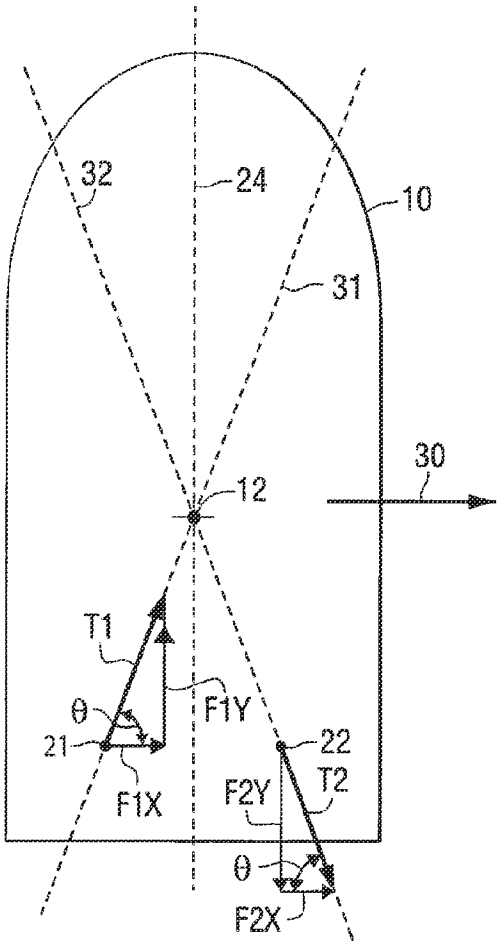

FIG. 3 shows the first and second thrust vectors, T1 and T2, and the resultant forces of those two thrust vectors. For example, the first thrust vector can be resolved into a forward directed force F1Y and a side directed force F1X as shown in FIG. 3 by multiplying the first thrust vector T1 by the sine of theta and the cosine of theta, respectively. Similarly, the second thrust vector T2 is shown resolved into a rearward directed force F2Y and a side directed force F2X by multiplying the second thrust vector T2 by the sine of theta and cosine of theta, respectively. Since the forward force F1Y and rearward force F2Y are equal to each other, they cancel and no resulting forward or reverse force is exerted on the marine vessel 10. The side directed forces, F1X and F2X, on the other hand, are additive and result in the sidle movement represented by arrow 30. Because the lines, 31 and 32, intersect at the center of gravity 12 of the marine vessel 10, no resulting moment is exerted on the marine vessel. As a result, the only movement of the marine vessel 10 is the sidle movement represented by arrow 30.

Figure 4:
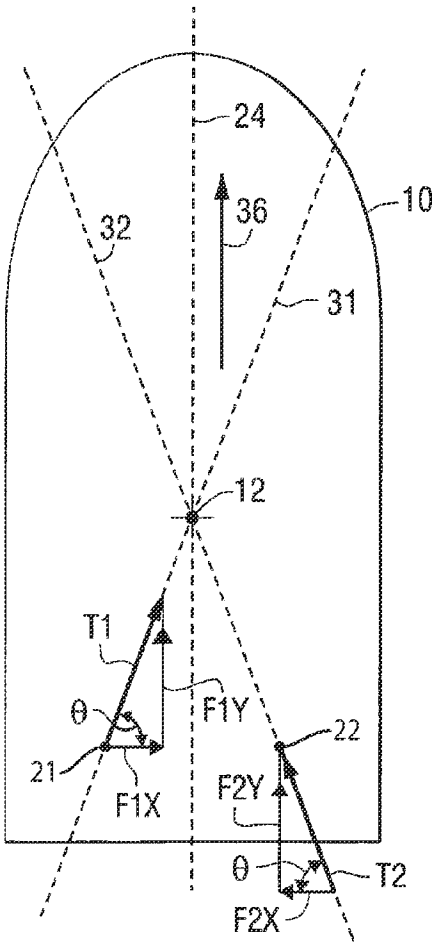
FIG. 4 shows the arrangement of thrust vectors for a forward movement.

FIG. 4 shows the result when the operator of the marine vessel 10 wishes to move in a forward direction, with no side movement and no rotation about the center of gravity 12. The first and second thrusts, T1 and T2, are directed along their respective lines, 31 and 32, and they intersect at the center of gravity 12. Both thrusts, T1 and T2, are exerted in a generally forward direction along those lines. As a result, these thrusts resolve into the forces illustrated in FIG. 4. Side directed forces F1X and F2X are equal to each other and in opposite directions. Therefore, they cancel each other and no sidle force is exerted on the marine vessel 10. Forces F1Y and F2Y, on the other hand, are both directed in a forward direction and result in the movement represented by arrow 36. The configuration of the first and second marine propulsion systems represented in FIG. 4 result in no side directed movement of the marine vessel 10 or rotation about its center of gravity 12. Only a forward movement 36 occurs.

When it is desired that the marine vessel 10 be subjected to a moment to cause it to rotate about its center of gravity 12, the application of the concepts of the present disclosure depend on whether or not it is also desired that the marine vessel 10 be subjected to a linear force in either the forward/reverse or the left/right direction or a combination of both. When the operator wants to cause a combined movement, with both a linear force and a moment exerted on the marine vessel, the thrust vectors, T1 and T2, are caused to intersect at the point 38 as represented by dashed lines 31 and 32 in FIG. 6. If, on the other hand, the operator of the marine vessel wishes to cause it to rotate about its center of gravity 10 with no linear movement in either a forward/reverse or a left/right direction, the thrust vectors, T1' and T2', are aligned in parallel association with each other and the magnitude of the first and second thrust vectors are directed in opposite directions as represented by dashed arrows T1' and T2' in FIG. 6. When the first and second thrust vectors, T1' and T2', are aligned in this way, the angle theta for both vectors is equal to 90 degrees and their alignment is symmetrical with respect to the centerline 24, but with oppositely directed thrust magnitudes.

Figure 5:
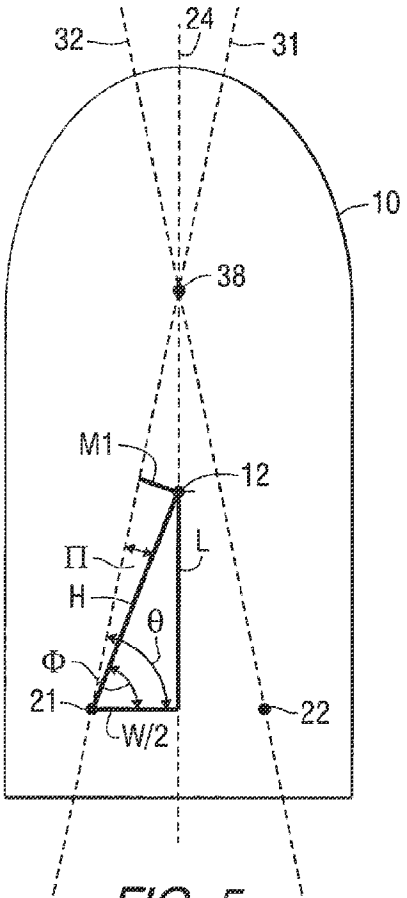
FIG. 5 illustrates the geometry associated with the calculation of a moment arm relative to the center of gravity of a marine vessel.

When a rotation of the marine vessel 10 is desired in combination with linear movement, the first and second marine propulsion devices are rotated so that their thrust vectors intersect at a point on the centerline 24 other than the center of gravity 12 of the marine vessel 10. This is illustrated in FIG. 5. Although the thrust vectors, T1 and T2, are not shown in FIG. 5, their associated lines, 31 and 32, are shown intersecting at a point 38 which is not coincident with the center of gravity 12. As a result, an effective moment arm MI exists with respect to the first marine propulsion device which is rotated about its first steering axis 21. Moment arm M1 is perpendicular to dashed line 31 along which the first thrust vector is aligned. As such, it is one side of a right triangle which also comprises a hypotenuse H. It should also be understood that another right triangle in FIG. 5 comprises sides L, W/2, and the hypotenuse H. Although not shown in FIG. 5, for purposes of clarity, a moment arm M2 of equal magnitude to moment arm M1 would exist with respect to the second thrust vector directed along line 32. Because of the intersecting nature of the thrust vectors, they each resolve into components in both the forward/reverse and left/right directions. The components, if equal in absolute magnitude to each other, may either cancel each other or be additive. If unequal in absolute magnitude, they may partially offset each other or be additive. However, a resultant force will exist in some linear direction when the first and second thrust vectors intersect at a point 38 on the centerline 24.

With continued reference to FIG. 5, those skilled in the art recognize that the length of the moment arm M1 can be determined as a function of angle theta, angle PHI, angle PI, the distance between the first and second steering axes, 21 and 22, which is equal to W in FIG. 5, and the perpendicular distance between the center of gravity 12 and a line extending between the first and second steering axes. This perpendicular distance is identified as L in FIG. 5. The length of the line extending between the first steering axis 21 and the center of gravity 12 is the hypotenuse of the triangle shown in FIG. 5 and can easily be determined. The magnitude of angle PHI is equivalent to the arctangent of the ratio of length L to the distance between the first steering axis 21 and the centerline 24, which is identified as W/2 in FIG. 5. Since the length of line H is known and the magnitude of angle H is known, the length of the moment arm M1 can be mathematically determined.

Figure 6:
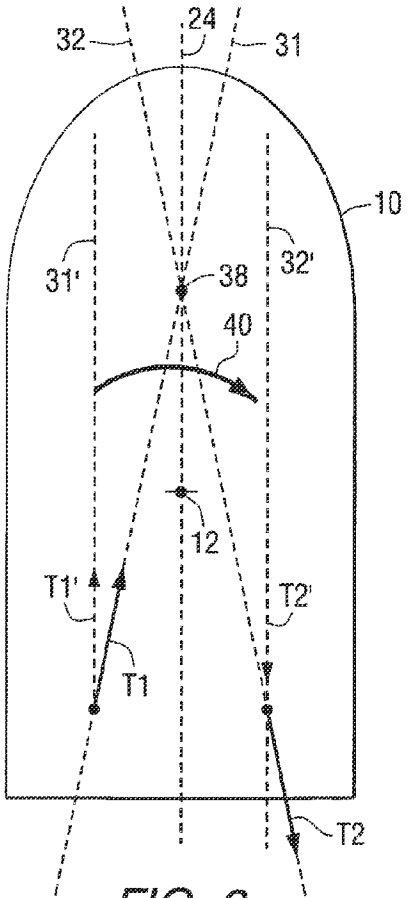
FIG. 6 shows the arrangement of thrust vectors used to rotate the marine vessel about its center of gravity.

As described above, a moment, represented by arrow 40 in FIG. 6, can be imposed on the marine vessel 10 to cause it to rotate about its center of gravity 12. The moment can be imposed in either rotational direction. In addition, the rotating force resulting from the moment 40 can be applied either in combination with a linear force on the marine vessel or alone. In order to combine the moment 40 with a linear force, the first and second thrust vectors, T1 and T2, are positioned to intersect at the point 38 illustrated in FIG. 6. The first and second thrust vectors, T1 and T2, are aligned with their respective dashed lines, 31 and 32, to intersect at this point 38 on the centerline 24 of the marine vessel. If, on the other hand, it is desired that the moment 40 be the only force on the marine vessel 10, with no linear forces, the first and second thrust vectors, represented by T1' and T2' in FIG. 6, are aligned in parallel association with each other. This, effectively, causes angle theta to be equal to 90 degrees. If the first and second thrust vectors, T1' and T2', are then applied with equal magnitudes and in opposite directions, the marine vessel 10 will be subjected only to the moment 40 and to no linear forces. This will cause the marine vessel 10 to rotate about its center of gravity 12 while not moving in either the forward/reverse or the left/right directions.

In FIG. 6, the first and second thrust vectors, T1 and T2, are directed in generally opposite directions and aligned to intersect at the point 38 which is not coincident with the center of gravity 12. Although the construction lines are not shown in FIG. 6, effective moment arms, M1 and M2, exist with respect to the first and second thrust vectors and the center of gravity 12. Therefore, a moment is exerted on the marine vessel 10 as represented by arrow 40. If the thrust vectors T1 and T2 are equal to each other and are exerted along lines 31 and 32, respectively, and these are symmetrical about the centerline 24 and in opposite directions, the net component forces parallel to the centerline 24 are equal to each other and therefore no net linear force is exerted on the marine vessel 10 in the forward/reverse directions. However, the first and second thrust vectors, T1 and T2, also resolve into forces perpendicular to the centerline 24 which are additive. As a result, the marine vessel 10 in FIG. 6 will move toward the right as it rotates in a clockwise direction in response to the moment 40.

In order to obtain a rotation of the marine vessel 10 with no lateral movement in the forward/reverse or left/right directions, the first and second thrust vectors, represented as T1' and T2' in FIG. 6, are directed along dashed lines, 31' and 32', which are parallel to the centerline 24. The first and second thrust vectors, T1' and T2', are of equal and opposite magnitude. As a result, no net force is exerted on the marine vessel 10 in a forward/reverse direction. Since angle theta, with respect to thrust vectors T1' and T2', is equal to 90 degrees, no resultant force is exerted on the marine vessel 10 in a direction perpendicular to the centerline 24. As a result, a rotation of the marine vessel 10 about its center of gravity 12 is achieved with no linear movement.

Figure 7:
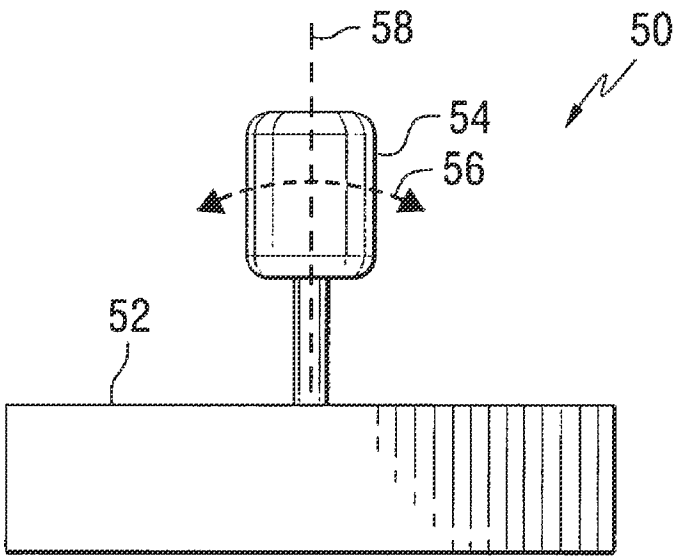

FIG. 7 is a simplified schematic representation of a joystick 50 which provides a manually operable control device which can be used to provide a signal that is representative of a desired movement, selected by an operator, relating to the marine vessel. Many different types of joysticks are known to those skilled in the art. The schematic representation in FIG. 7 shows a base portion 52 and a handle 54 which can be manipulated by hand. In a typical application, the handle is movable in the direction generally represented by arrow 56 and is also rotatable about an axis 58. It should be understood that the joystick handle 54 is movable, by tilting it about its connection point in the base portion 52 in virtually any direction. Although dashed line 56 is illustrated in the plane of the drawing in FIG. 7, a similar type movement is possible in other directions that are not parallel to the plane of the drawing.

Figure 8:
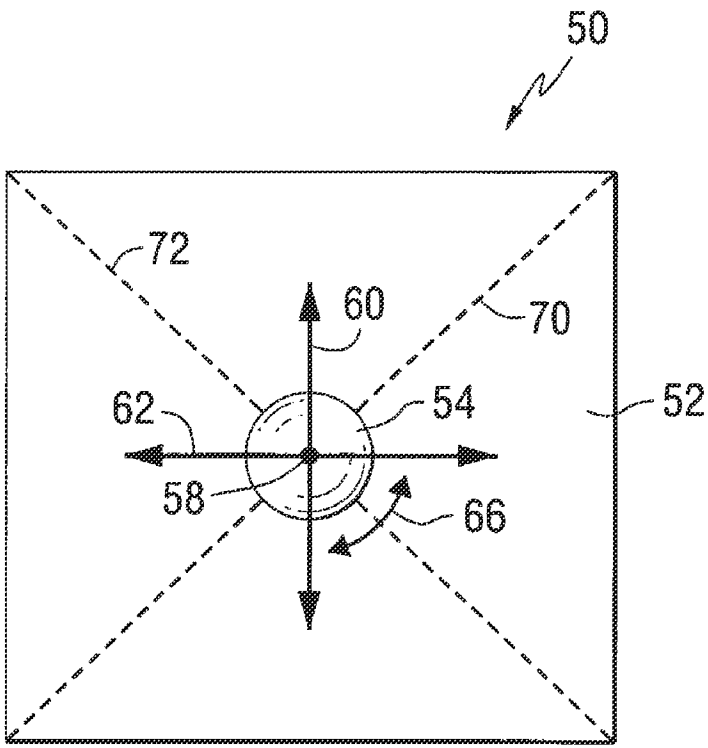
FIGS. 7 and 8 are two schematic representation of a joystick used in conjunction with the presently described embodiments.

FIG. 8 is a top view of the joystick 50. The handle 54 can move, as indicated by arrow 56 in FIG. 7, in various directions which include those represented by arrows 60 and 62. However, it should be understood that the handle 54 can move in any direction relative to axis 58 and is not limited to the two lines of movement represented by arrows 60 and 62. In fact, the movement of the handle 54 has a virtually infinite number of possible paths as it is tilted about its connection point within the base 52. The handle 54 is also rotatable about axis 58, as represented by arrow 66. Those skilled in the art are familiar with many different types of joystick devices that can be used to provide a signal that is representative of a desired movement of the marine vessel, as expressed by the operator of the marine vessel through movement of the handle 54.

With continued reference to FIG. 8, it can be seen that the operator can demand a purely linear movement either toward port or starboard, as represented by arrow 62, a purely linear movement in a forward or reverse direction as represented by arrow 60, or any combination of the two. In other words, by moving the handle 54 along dashed line 70, a linear movement toward the right side and forward or toward the left side and rearward can be commanded. Similarly, a linear movement along lines 72 could be commanded. Also, it should be understood that the operator of the marine vessel can request a combination of sideways or forward/reverse linear movement in combination with a rotation as represented by arrow 66. Any of these possibilities can be accomplished through use of the joystick 50. The magnitude, or intensity, of movement represented by the position of the handle 54 is also provided as an output from the joystick. In other words, if the handle 54 is moved slightly toward one side or the other, the commanded thrust in that direction is less than if, alternatively, the handle 54 was moved by a greater magnitude away from its vertical position with respect to the base 52. Furthermore, rotation of the handle 54 about axis 58, as represented by arrow 66, provides a signal representing the intensity of desired movement. A slight rotation of the handle about axis 58 would represent a command for a slight rotational thrust about the center of gravity 12 of the marine vessel 10. On the other hand, a more intense rotation of the handle 54 about its axis would represent a command for a higher magnitude of rotational thrust.

With reference to FIGS. 1-8, it can be seen that movement of the joystick handle 54 can be used by the operator of the marine vessel 10 to represent virtually any type of desired movement of the vessel. In response to receiving a signal from the joystick 50, an algorithm, in accordance with a preferred embodiment, determines whether or not a rotation 40 about the center of gravity 12 is requested by the operator. If no rotation is requested, the first and second marine propulsion devices are rotated so that their thrust vectors align, as shown in FIGS. 2-4, with the center of gravity 12 and intersect at that point. This results in no moment being exerted on the marine vessel 10 regardless of the magnitudes or directions of the first and second thrust vectors, T1 and T2. The magnitudes and directions of the first and second thrust vectors are then determined mathematically, as described above in conjunction with FIGS. 3 and 4. If, on the other hand, the signal from the joystick 50 indicates that a rotation about the center of gravity 12 is requested, the first and second marine propulsion devices are directed along lines, 31 and 32, that do not intersect at the center of gravity 12. Instead, they intersect at another point 38 along the centerline 24. As shown in FIG. 6, this intersection point 38 can be forward from the center of gravity 12. The thrusts, T1 and T2, shown in FIG. 6 result in a clockwise rotation 40 of the marine vessel 10. Alternatively, if the first and second marine propulsion devices are rotated so that they intersect at a point along the centerline 24 which is behind the center of gravity 12, an opposite effect would be realized. It should also be recognized that, with an intersect point 38 forward from the center of gravity 12, the directions of the first and second thrusts, T1 and T2, could be reversed to cause a rotation of the marine vessel 10 in a counterclockwise direction.

In the various maneuvering steps described in conjunction with FIGS. 1-6, it can be seen that the first and second marine propulsion devices are directed so that they intersect along the centerline 24. That point of intersection can be at the center of gravity 12 or at another point such as point 38. In addition, the lines, 31 and 32, along which the first and second thrust vectors are aligned, are symmetrical in all cases. In other words, the first and second marine propulsion devices are positioned at angles theta relative to a line perpendicular to the centerline 24. The thrust vectors are, however, aligned in opposite directions relative to the centerline 24 so that they are symmetrical to the centerline even though they may be in opposite directions as illustrated in FIG. 6.

While it is recognized that the movements of the marine vessel 10 described above can be accomplished by rotating the marine propulsion devices in an asymmetrical way, contrary to the description of the present disclosure in relation to FIGS. 1-6, the speed and consistency of movement are enhanced by the consistent alignment of the first and second thrust vectors at points along the centerline 24 and, when no rotation about the center of gravity 12 is required, at the center of gravity itself. This symmetrical movement and positioning of the first and second marine propulsion devices simplifies the necessary calculations to determine the resolved forces and moments and significantly reduces the effects of any errors in the thrust magnitudes.

As described above, in conjunction with FIGS. 1-6, the first and second thrust vectors, T1 and T2, can result from either forward or reverse operation of the propellers of the first and second marine propulsion devices. In other words, with respect to FIG. 6, the first thrust vector T1 would typically be provided by operating the first marine propulsion device in forward gear and the second thrust vector T2 would be achieved by operating the second marine propulsion device in reverse gear. However, as is generally recognized by those skilled in the art, the resulting thrust obtained from a marine propulsion device by operating it in reverse gear is not equal in absolute magnitude to the resulting thrust achieved by operating the propeller in forward gear. This is the result of the shape and hydrodynamic effects caused by rotating the propeller in a reverse direction. However, this effect can be determined and calibrated so that the rotational speed (RPM) of the reversed propeller can be selected in a way that the effective resulting thrust can be accurately predicted. In addition, the distance L between the line connecting the first and second steering axes, 21 and 22, and the center of gravity 12 must be determined for the marine vessel 10 so that the operation of the algorithm of the present disclosure is accurate and optimized. This determination is relatively easy to accomplish. Initially, a presumed location of the center of gravity 12 is determined from information relating to the structure of the marine vessel 10. With reference to FIG. 3, the first and second marine propulsion devices are then aligned so that their axes, 31 and 32, intersect at the presumed location of the center of gravity 12. Then, the first and second thrusts, T1 and T2, are applied to achieve the expected sidle movement 30. If any rotation of the marine vessel 10 occurs, about the actual center of gravity, the length L (illustrated in FIG. 5) is presumed to be incorrect. That length L in the microprocessor is then changed slightly and the procedure is repeated. When the sidle movement 30 occurs without any rotation about the currently assumed center of gravity, it can be concluded that the currently presumed location of the center of gravity 12 and the magnitude of length L are correct. It should be understood that the centerline 24, in the context of the present disclosure, is a line which extends through the center of gravity of the marine vessel 10. It need not be perfectly coincident with the keel line of the marine vessel, but it is expected that in most cases it will be.

As mentioned above, propellers do not have the same effectiveness when operated in reverse gear than they do when operated in forward gear for a given rotational speed. Therefore, with reference to FIG. 3, the first thrust T1 would not be perfectly equal to the second thrust T2 if the two propellers systems were operated at identical rotational speeds. In order to determine the relative efficiency of the propellers when they are operated in reverse gear, a relatively simple calibration procedure can be followed. With continued reference to FIG. 3, first and second thrusts, T1 and T2, are provided in the directions shown and aligned with the center of gravity 12. This should produce the sidle movement 30 as illustrated. However, this assumes that the two thrust vectors, T1 and T2, are equal to each other. In a typical calibration procedure, it is initially assumed that the reverse operating propeller providing the second thrust T2 would be approximately 80% as efficient as the forward operating propeller providing the first thrust vector T1. The rotational speeds were selected accordingly, with the second marine propulsion device operating at 125% of the speed of the first marine propulsion device. If a forward or reverse movement is experienced by the marine vessel 10, that initial assumption would be assumed to be incorrect. By slightly modifying the assumed efficiency of the reverse operating propeller, the system can eventually be calibrated so that no forward or reverse movement of the marine vessel 10 occurs under the situation illustrated in FIG. 3. In an actual example, this procedure was used to determine that the operating efficiency of the propellers, when in reverse gear, is approximately 77% of their efficiency when operated in forward gear. Therefore, in order to balance the first and second thrust vectors, T1 and T2, the reverse operating propellers of the second marine propulsion device would be operated at a rotational speed (i.e. RPM) which is approximately 29.87% greater than the rotational speed of the propellers of the first marine propulsion device. Accounting for the inefficiency of the reverse operating propellers, this technique would result in generally equal magnitudes of the first and second thrust vectors, T1 and T2.

Figure 9:
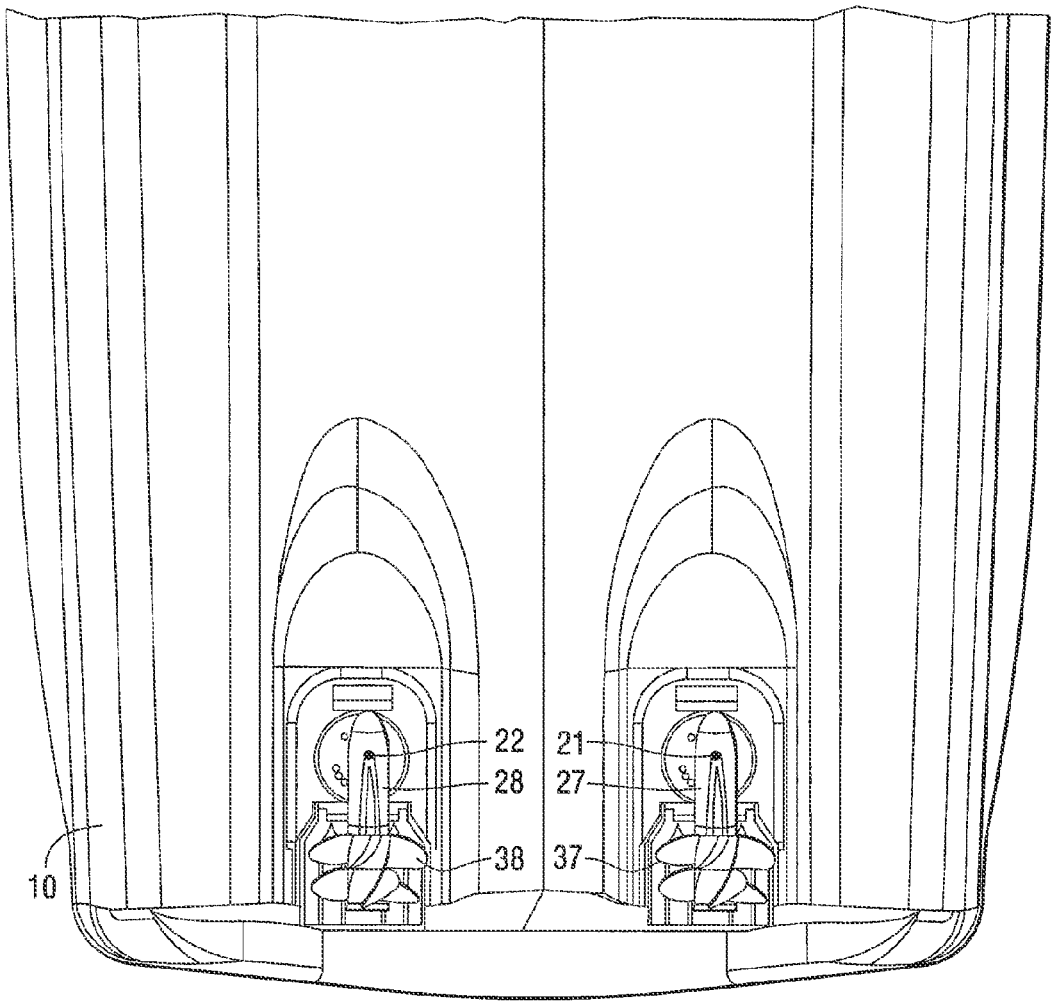
FIG. 9 is a bottom view of the hull of a marine vessel showing the first and second marine propulsion devices extending therethrough.

FIG. 9 is an isometric view of the bottom portion of a hull of a marine vessel 10, showing first and second marine propulsion devices, 27 and 28, and propellers, 37 and 38, respectively. The first and second marine propulsion devices, 27 and 28, are rotatable about generally vertical steering axes, 21 and 22, as described above. In order to avoid interference with portions of the hull of the marine vessel 10, the two marine propulsion devices are provided with limited rotational steering capabilities as described above. Neither the first nor the second marine propulsion device is provided, in a particularly preferred embodiment of the present disclosure, with the capability of rotating 360 degrees about its respective steering axis, 21 or 22.

Figure 10:
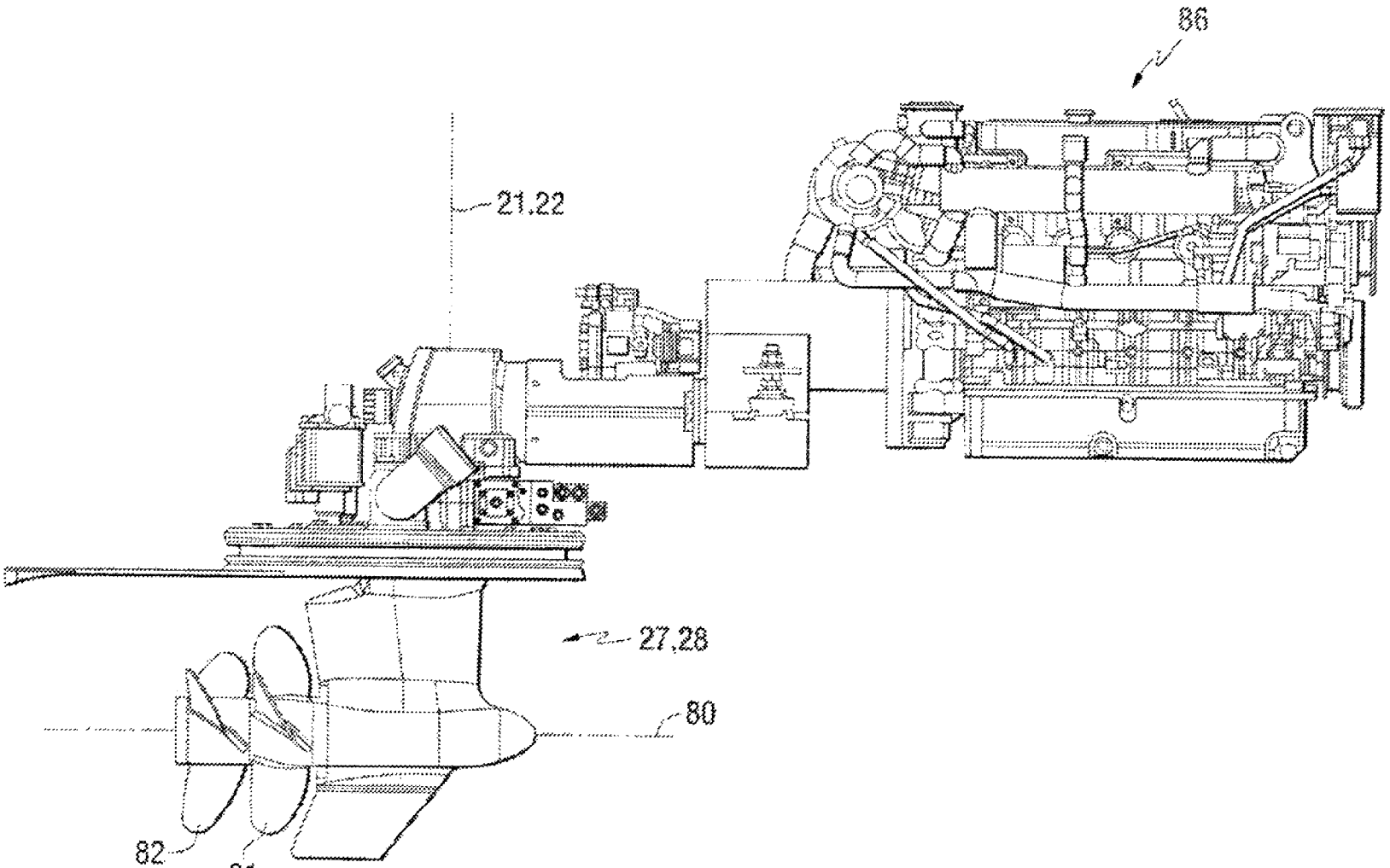
FIG. 10 is a side view showing the arrangement of an engine, steering mechanism, and marine propulsion device used in conjunction with the presently described embodiments.

FIG. 10 is a side view showing the arrangement of a marine propulsion device, such as 27 or 28, associated with a mechanism that is able to rotate the marine propulsion device about its steering axis, 21 or 22. Although not visible in FIG. 10, the driveshaft of the marine propulsion device extends vertically and parallel to the steering axis and is connected in torque transmitting relation with a generally horizontal propeller shaft that is rotatable about a propeller axis 80. The embodiment shown in FIG. 10 comprises two propellers, 81 and 82, that are attached to the propeller shaft. The motive force to drive the propellers, 81 and 82, is provided by an internal combustion engine 86 that is located within the bilge of the marine vessel 10. It is configured with its crankshaft aligned for rotation about a horizontal axis. In a particularly preferred embodiment, the engine 86 is a diesel engine. Each of the two marine propulsion devices, 27 and 28, is driven by a separate engine 86. In addition, each of the marine propulsion devices, 27 and 28, are independently steerable about their respective steering axes, 21 or 22. The steering axes, 21 and 22, are generally vertical and parallel to each other. They are not intentionally configured to be perpendicular to the bottom surface of the hull. Instead, they are generally vertical and intersect the bottom surface of the hull at an angle that is not equal to 90 degrees when the bottom surface of the hull is a V-type hull or any other shape which does not include a flat bottom.

With continued reference to FIG. 10, the submerged portion of the marine propulsion device, 27 or 28, contains rotatable shafts, gears, and bearings which support the shafts and connect the driveshaft to the propeller shaft for rotation of the propellers. No source of motive power is located below the hull surface. The power necessary to rotate the propellers is solely provided by the internal combustion engine. Alternate propulsive means could be employed such as electric motors and the like.

Figure 11:
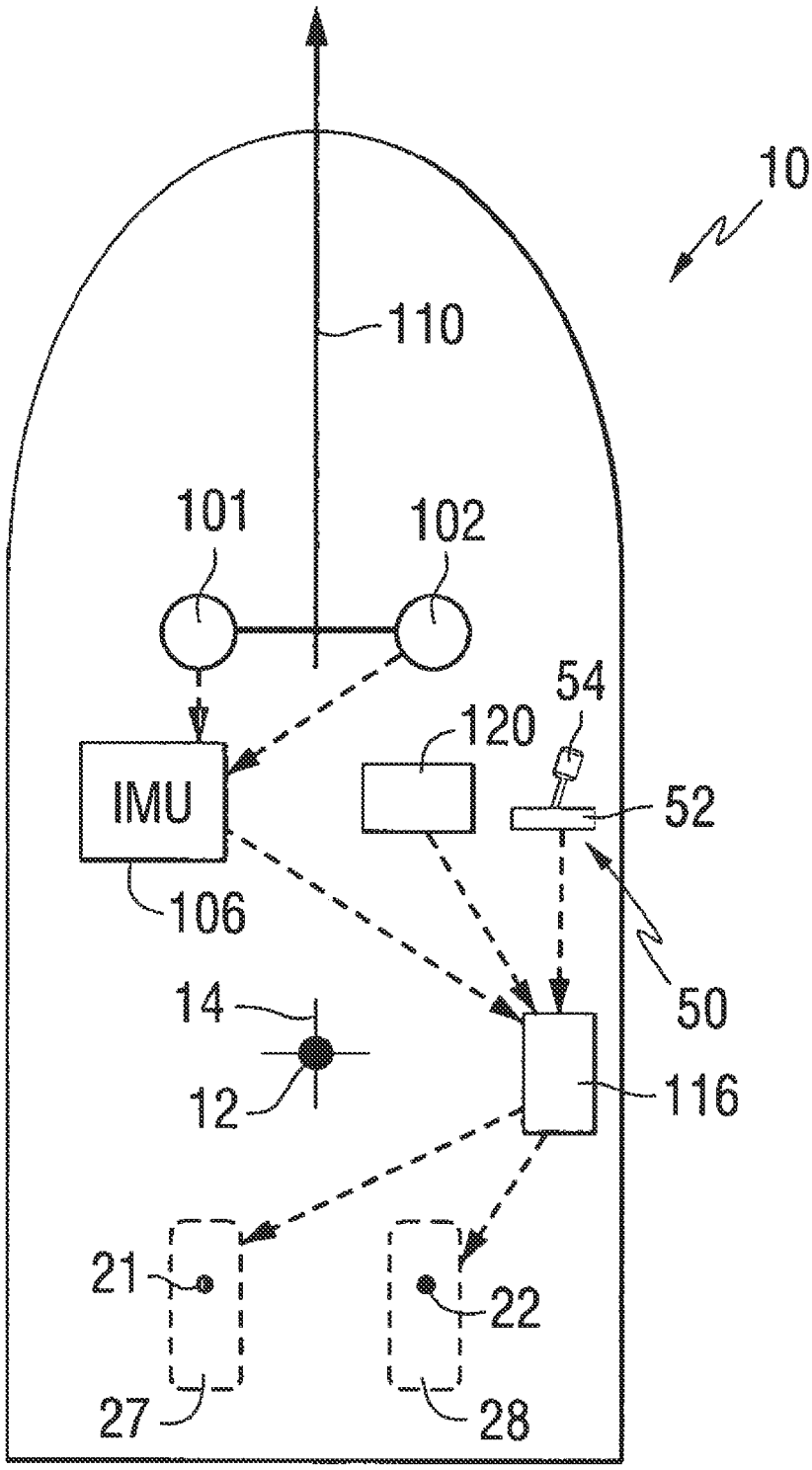
FIG. 11 is a schematic representation of a marine vessel equipped with the devices for performing the station keeping function of the presently described embodiments.

FIG. 11 is a schematic representation of a marine vessel 10 which is configured to perform the steps of a preferred embodiment relating to a method for maintaining a marine vessel in a selected position. The marine vessel 10 is provided with a global positioning system (GPS) which, in a preferred embodiment, comprises a first GPS device 101 and a second GPS device 102 which are each located at a preselected fixed position on the marine vessel 10. Signals from the GPS devices are provided to an inertial measurement unit (IMU) 106. The IMU is identified as model RT3042 and is available in commercial quantities from Oxford Technology. In certain embodiments of the IMU 106, it comprises a differential correction receiver, accelerometers, angular rate sensors, and a microprocessor which manipulates the information obtained from these devices to provide information relating to the current position of the marine vessel 10, in terms of longitude and latitude, the current heading of the marine vessel 10, represented by arrow 110 in FIG. 11, and the velocity and acceleration of the marine vessel 10 in six degrees of freedom.

FIG. 11 also shows a microprocessor 116 which receives inputs from the IMU 106. The microprocessor 116 also receives information from a device 120 which allows the operator of the marine vessel 10 to provide manually selectable modes of operation. As an example, the device 120 can be an input screen that allows the operator of the marine vessel to manually select various modes of operation associated with the marine vessel 10. One of those selections made by the operator of the marine vessel can provide an enabling signal which informs the microprocessor 116 that the operator desires to operate the vessel 10 in a station keeping mode in order to maintain the position of the marine vessel in a selected position. In other words, the operator can use the device 120 to activate the present system so that the marine vessel 10 is maintained at a selected global position (e.g. a selected longitude and latitude) and a selected heading (e.g. with arrow 110 being maintained at a fixed position relative to a selected compass point).

With continued reference to FIG. 11, a manually operable control device, such as the joystick 50, can also be used to provide a signal to the microprocessor 116. As described above, the joystick 50 can be used to allow the operator of the marine vessel 10 to manually maneuver the marine vessel. It can also provide information to the microprocessor 116 regarding its being in an active status or inactive status. While the operator is manipulating the joystick 50, the joystick is in an active status. However, if the operator releases the joystick 50 and allows the handle 54 to return to its centered and neutral position, the joystick 50 reverts to an inactive status. As will be described in greater detail below, a particularly preferred embodiment can use the information relating to the active or inactive status of the joystick 50 in combination with an enabling mode received from the device 120 to allow the operator to select the station keeping mode of the present disclosure. In this embodiment, the operator can use the joystick 50 to manually maneuver the marine vessel 10 into a particularly preferred position, represented by a global position and a heading, and then release the joystick 50 to immediately and automatically request the control system to maintain that newly achieved global position and heading. This embodiment can be particularly helpful during docking procedures.

As described above, the first and second marine propulsion devices, 27 and 28, are steerable about their respective axes, 21 and 22. Signals provided by the microprocessor 116 allow the first and second marine propulsion devices to be independently rotated about their respective steering axes in order to coordinate the movement of the marine vessel 10 in response to operator commands.

Figure 12:
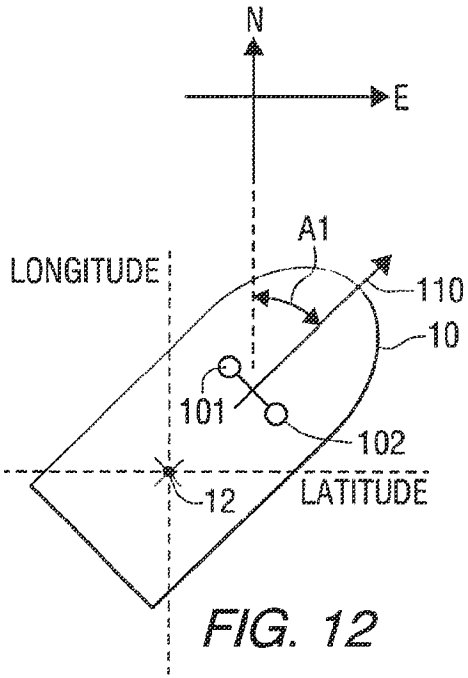
FIG. 12 is a representation of a marine vessel at a particular global position and with a particular heading which are exemplary.

FIG. 12 shows a marine vessel 10 at an exemplary global position, measured as longitude and latitude, and an exemplary heading represented by angle A1 between the heading arrow 110 of the marine vessel 10 and a due north vector. Although alternative position defining techniques can be used in conjunction with the presently described embodiments, a preferred embodiment uses both the global position and heading of the vessel 10 for the purpose of determining the current position of the vessel and calculating the necessary position corrections to return the vessel to its position.

As described above, GPS devices, 101 and 102, are used by the IMU 106 to determine the information relating to its position. For purposes of describing a preferred embodiment, the position will be described in terms of the position of the center of gravity 12 of the marine vessel and a heading vector 110 which extends through the center of gravity. However, it should be understood that alternative locations on the marine vessel 10 can be used for these purposes. The IMU 106, described above in conjunction with FIG. 11, provides a means by which this location on the marine vessel 10 can be selected.

The station keeping function, where it maintains the desired global position and desired heading of the marine vessel, can be activated in several ways. In a simple embodiment, the operator of the marine vessel 10 can actuate a switch that commands the microprocessor 116 to maintain the current position whenever the switch is actuated. In a particularly preferred embodiment, the station keeping mode is activated when the operator of the marine vessel enables the station keeping, or position maintaining, function and the joystick 50 is inactive. If the station keeping mode is enabled, but the joystick is being manipulated by the operator of the marine vessel 10, a preferred embodiment temporarily deactivates the station keeping mode because of the apparent desire by the operator of the marine vessel to manipulate its position manually. However, as soon as the joystick 50 is released by the operator, this inactivity of the joystick in combination with the enabled station keeping mode causes the preferred embodiment of to resume its position maintaining function.

Figure 13:
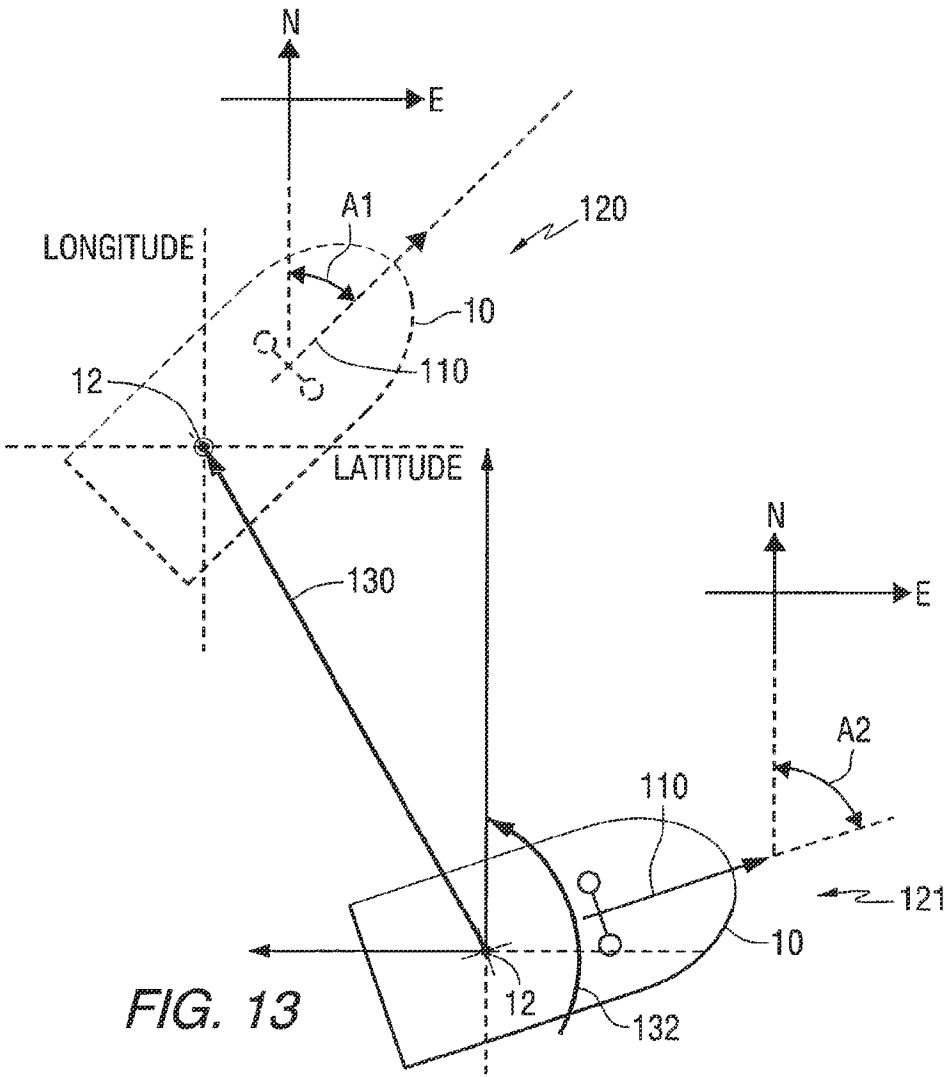
FIG. 13 shows a marine vessel which has moved from an initial position to a subsequent position.

FIG. 13 is a schematic representation that shows the marine vessel 10 in two exemplary positions. An initial, or desired, position 120 is generally identical to that described above in conjunction with FIG. 12. Its initial position is defined by a global position and a heading. The global position is identified by the longitude and latitude of the center of gravity 12 when the vessel 10 was at its initial, or desired, position 120. The heading, represented by angle A1, is associated with the vessel heading when it was at its initial position 120.

Assuming that the vessel 10 moved to a subsequent position 121, the global position of its center of gravity 12 moved to the location represented by the subsequent position 121 of the vessel 10. In addition, the marine vessel 10 is illustrated as having rotated slightly in a clockwise direction so that its heading vector 110 is now defined by a larger angle A2 with respect to a due north vector.

With continued reference to FIG. 13, it should be understood that the difference in position between the initial position 120 and the later position 121 is significantly exaggerated so that the response by the system can be more clearly described. A preferred embodiment determines a difference between a desired position, such as the initial position 120, and the current position, such as the subsequent position 121 that resulted from the vessel 10 drifting. This drift of the vessel 10 can occur because of wind, tide, or current.

The current global position and heading of the vessel is compared to the previously stored desired global position and heading. An error, or difference, in the north, east and heading framework is computed as the difference between the desired global position and heading and the actual global position and heading. This error, or difference, is then converted to an error, or difference, in the forward, right and heading framework of the vessel which is sometimes referred to as the body framework. These vessel framework error elements are then used by the control strategies that will be described in greater detail below which attempt to simultaneously null the error, or difference, elements. Through the use of a PID controller, a desired force is computed in the forward and right directions, with reference to the marine vessel, along with a desired YAW moment relative to the marine vessel in order to null the error elements. The computed force and moment elements are then transmitted to the vessel maneuvering system described above which delivers the requested forces and moments by positioning the independently steerable marine propulsion drives, controlling the power provided to the propellers of each drive, and controlling the thrust vector directions of both marine propulsion devices.

The difference between the desired position 120 and the current position 121 can be reduced if the marine vessel 10 is subjected to an exemplary target linear thrust 130 and a target moment 132. The target linear thrust 130 and the target moment 132, in a preferred embodiment, are achieved by a manipulation of the first and second marine propulsion devices as described above in conjunction with FIGS. 2-6. The target linear thrust 130 will cause the marine vessel 10 to move towards its initial, or desired, position which is measured as a magnitude of longitude and latitude. The target moment 132 will cause the marine vessel 10 to rotate about its center of gravity 12 so that its heading vector 110 moves from the current position 121 to the initial position 120. This reduces the heading angle from the larger magnitude of angle A2 to the smaller magnitude of A1. Both the target linear thrust 130 and target moment 132 are computed to decrease the errors between the current global position and heading at location 121 and the desired global position and heading at the desired position 120.

With continued reference to FIG. 13, it should be recognized that the station keeping mode is not always intended to move the marine vessel 10 by significant distances. Instead, its continual response to slight changes in global position and heading will more likely maintain the vessel in position without requiring perceptible movements of the vessel 10. In other words, the first and second marine propulsion devices are selectively activated in response to slight deviations in the global position and heading of the marine vessel and, as a result, large corrective moves such as that which is illustrated in FIG. 13 will not normally be required. As a result, the thrusts provided by the first and second marine propulsion devices continually counter the thrusts on the marine vessel caused by wind, current, and tide so that the net result is an appearance that the marine vessel is remaining stationary and is unaffected by the external forces. However, alternative embodiments could be used to cause the marine vessel 10 to move to a position, defined by a desired global position and heading, that was previously stored in the microprocessor memory. Under those conditions, a relatively larger target linear thrust 130 and target moment 132 could be used to move the vessel 10 to the initial position when that initial position is selected from memory and the station keeping mode is enabled. As an example of this alternate embodiment, a desired position, such as the position identified by reference numeral 120 in FIG. 13, can be stored in the microprocessor and then recalled, perhaps days later, after the operator of the marine vessel 10 has moved the marine vessel to a position in the general vicinity of the stored position 120. In other words, if the operator of the marine vessel maneuvers it to a location, such as the location identified by reference numeral 121 in FIG. 13, the system can be enabled and activated. Under those conditions, the system will cause the marine vessel to move to its stored desired position 120 that was selected and saved at some previous time. This technique could possibly be advantageous in returning the marine vessel to a desirable fishing location or to a docking position after the operator has maneuvered the marine vessel into a position that is generally close to the desired position.

In a particularly preferred embodiment, the microprocessor 116, as described above in conjunction with FIG. 11, allows the operator to manually manipulate the joystick 50 so that the marine vessel is positioned in response to the desire of the operator. As this process continues, the operator of the marine vessel may choose to release the joystick 50. At that instant in time, the station keeping mode is immediately activated, if enabled, and the marine vessel is maintained at the most recent position and heading of the vessel 10 when the joystick 50 initially became inactive as the operator released it. The operator could subsequently manipulate the joystick again to make slight corrections in the position and heading of the vessel. As that is being done, the station keeping mode is temporarily deactivated. However, if the operator of the marine vessel again releases the joystick 50, its inactivity will trigger the resumption of the station keeping method if it had been previously enabled by the operator.

Figure 14:
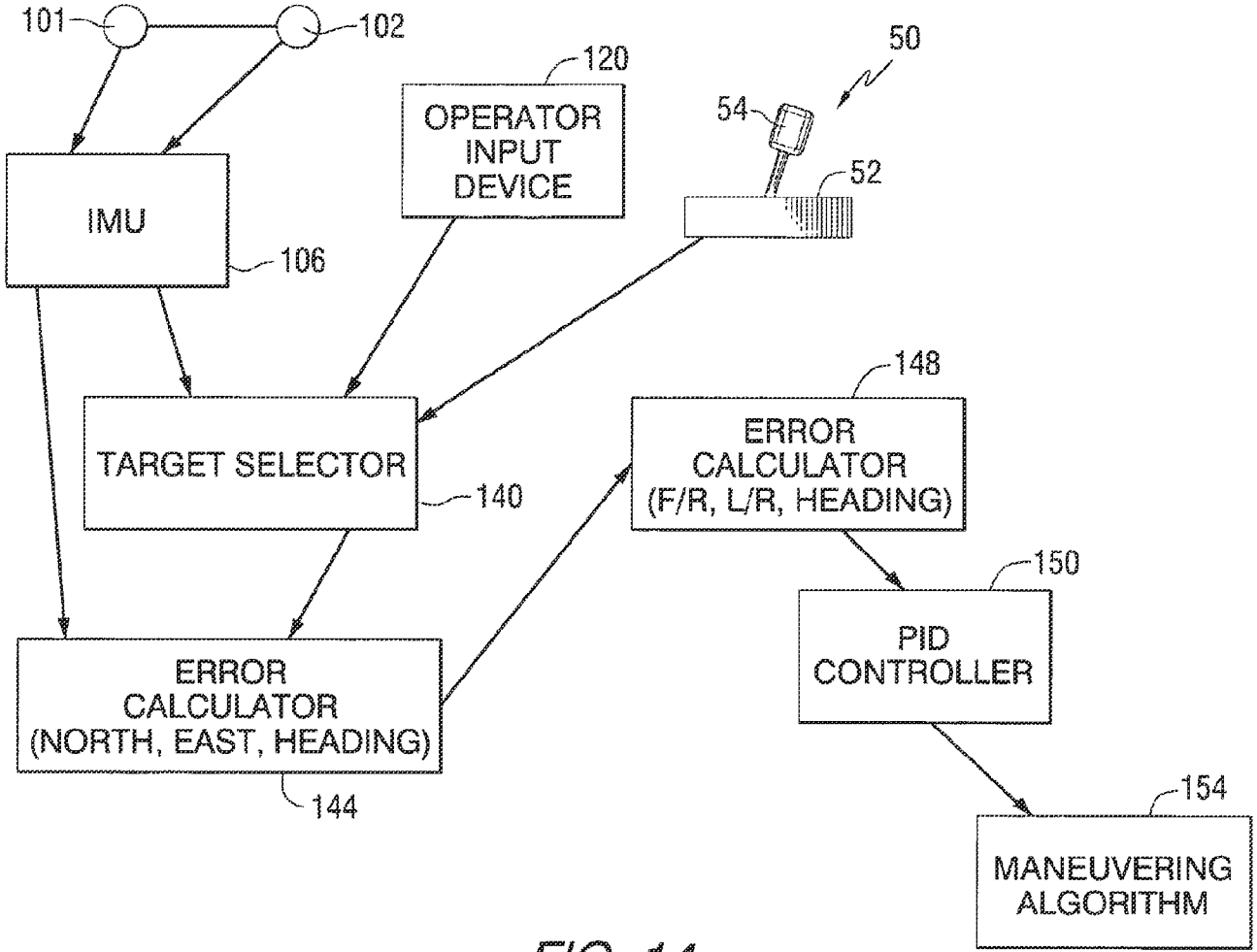
FIG. 14 is a block diagram of the functional elements of the presently described embodiments used to perform a station keeping function.

FIG. 14 is a schematic representation of the devices and software used in conjunction with the preferred embodiment. With references to FIGS. 11-14, the inertial measurement unit (IMU) 106 receives signals from the two GPS devices, 101 and 102, and provides information to the microprocessor 116 in relation to the absolute global position and heading of the marine vessel 10 and in relation to the velocity and acceleration of the marine vessel 10 in six degrees of freedom which include forward and reverse movement of the vessel, left and right movement of the vessel, and both yaw movements of the vessel.

With continued reference to FIG. 14, a target selector portion 140 of the software receives inputs from the IMU 106, the operator input device 120, and the joystick 50. When the station keeping mode is enabled, by an input from the operator of the marine vessel through the operator input device 120, and the joystick 50 is inactive, the target selector receives a current set of magnitudes from the IMU 106 and stores those values as the target global position and target heading for the vessel 10. A preferred embodiment is programmed to obtain this target position information only when the station keeping mode is enabled by the device 120 and the joystick 50 initially becomes inactive after having been active. This target information is stored by the microprocessor 116.

When in the station keeping mode, the IMU 106 periodically obtains new data from the GPS devices, 101 and 102, and provides the position information to an error calculator 144 within the microprocessor 116. This error calculator compares the target global position and target heading to current values of these two variables. That produces a difference magnitude which is defined in terms of a north-south difference and an east-west difference in combination with a heading angular difference. These are graphically represented as the target linear thrust 130 and the target moment 132. The target linear thrust 130 is the net difference in the longitude and latitude positions represented by the target position and current position. The heading difference is the angular difference between angles A2 and A1 in FIG. 13.

This information, which is described in terms of global measurements and which are in reference to stationary global references, are provided to an error calculator 148 which resolves those values into forward-reverse, left-right, and heading changes in reference to clockwise and counterclockwise movement of the marine vessel 10. These errors are provided to a PID controller 150.

As is generally known to those skilled in the art, a PID controller uses proportional, integral, and derivative techniques to maintain a measured variable at a preselected set point. Examples of this type of controller are used in cruise control systems for automobiles and temperature control systems of house thermostats. In the proportional band of the controller, the controller output is proportional to the error between the desired magnitude and the measured magnitude. The integral portion of the controller provides a controller output that is proportional to the amount of time that an error, or difference, is present. Otherwise, an offset (i.e. a deviation from set point) can cause the controller to become unstable under certain conditions. The integral portion of the controller reduces the offset. The derivative portion of the controller provides an output that is proportional to the rate of change of the measurement or of the difference between the desired magnitude and the actual current magnitude.

Each of the portions, or control strategies, of the PID controller typically uses an individual gain factor so that the controller can be appropriately tuned for each particular application. It should be understood that specific types of PID controllers and specific gains for the proportional, integral, and derivative portions of the controller are not limiting.

With continued reference to FIG. 14, the error correction information provided by the PID controller 150 is used by the maneuvering algorithm 154 which is described above in greater detail. The maneuvering algorithm receives information describing the required corrective vectors, both the linear corrective vector and the moment corrective vector, necessary to reduce the error or difference between the current global position and heading and the target global position and heading.

As described above, the method for positioning a marine vessel 10, in accordance with a particularly preferred embodiment, comprises the steps of obtaining a measured position of the marine vessel 10. As described in conjunction with FIGS. 11-14, the measured position of the marine vessel is obtained through the use of the GPS devices 101 and 102, in cooperation with the inertial measurement unit (IMU) 106. The present embodiment further comprises the step of selecting a desired position of the marine vessel. This is done by a target selector 140 that responds to being placed in an enabling mode by an operator input device 120 in combination with a joystick 50 being placed in an inactive mode. When those situations occur, the target selector 140 saves the most recent magnitudes of the global position and heading provided by the IMU 106 as the target global position and target heading. A preferred embodiment further comprises the step of determining a current position of the marine vessel 10. This is done, in conjunction with the error calculator 144, by saving the most recent magnitude received from the IMU 106. The present embodiment further comprises the step of calculating a difference between the desired and current positions of the marine vessel. These differences, in a particularly preferred embodiment, are represented by the differences, in longitude and latitude positions, of the center of gravity 12 of the marine vessel between the desired and current positions. The preferred embodiment then determines the required movements to reduce the magnitude of that difference. This is done through the use of a PID controller 150. Once these movements are determined, the first and second marine propulsion devices are used to maneuver the marine vessel 10 in such a way that it achieves the required movements to reduce the difference between the desired position and the current position. The steps used efficiently and accurately maneuver the marine vessel 10 in response to these requirements is described above in detail in conjunction with FIGS. 1-10.

With reference to FIGS. 11 and 14, it should be understood that an alternative embodiment could replace the two GPS devices, 101 and 102, with a single GPS device that provides information concerning the global position, in terms of longitude and latitude, of the marine vessel 10. This single GPS device could be used in combination with an electronic compass which provides heading information, as represented by arrow 110, pertaining to the marine vessel 10. In other words, it is not necessary in all embodiments to utilize two GPS devices to provide both global position and heading information. In the particularly preferred embodiment described above, the two GPS devices work in cooperation with the IMU 106 to provide additional information beyond the global position. In addition to providing information relating to the heading of the marine vessel 10, as represented by arrow 110, the two GPS devices in association with the IMU 106 provide additional information as described above in greater detail. Alternative embodiments, which utilize a single GPS device in cooperation with an electronic compass, are also within the scope of the present disclosure. In fact, any combination of devices that is able to provide information identifying the global position and heading of the marine vessel 10 can be used in conjunction with the present embodiment.

With continued reference to FIGS. 11 and 14, it should also be understood that the IMU 106 could be used as a separate unit which provides data into another device, or vice versa, for the purpose of providing information relating to position and heading correction information. It should therefore be clearly understood that alternative configurations of the IMU 106 and microprocessor 116 could be used in conjunction with the present embodiments as long as the system is able to provide information relating to the appropriate corrections necessary to cause the marine vessel 10 to move toward a desired position in such a way that its center of gravity 12 remains at its desired position and the heading, as represented by arrow 110, is maintained at the desired heading position of the marine vessel. Many different embodiments can be incorporated in the marine vessel 10 for the purposes of providing the information relating to the global position, the heading of marine vessel 10, and the appropriate thrust vectors necessary to achieve an effective correction of the position and heading of the marine vessel so that it remains at the desired position.

Although the description regarding FIGS. 1-14 relates to a vessel 10 that is maneuverable by first and second marine propulsion devices, it should be recognized that the present disclosure is not limited to such an arrangement. For example, the concepts discussed in this disclosure are operable in conjunction with a system or vessel that is maneuverable by more than two marine propulsion devices, which can include any type of device for providing a propulsive power, such as an inboard arrangement, outboard arrangement, pod arrangement, etc. Further, the concepts disclosed herein are not limited to arrangements that include a pair of global positioning devices and a single IMU unit. Rather, the concepts disclosed herein can be accomplished with more or less such units according to known vessel positioning control structures.

The present inventors have recognized that the amount of available thrust for positioning the vessel 10 varies as the microprocessor 116 carries out the station keeping functionality described hereinabove. For example with reference to FIGS. 1-4, the available thrust to move the vessel 10 sideways in the direction of arrow 30 is necessarily less than the available thrust to move the vessel 10 forward in the direction of arrow 36. This difference is because (1) propulsion devices such as propeller drives are more efficient while rotating in a forward direction than in a reverse direction and (2) propulsion devices will be more efficient when aligned in the direction of movement of the vessel 10, such as along lines 31' and 32' in FIG. 6, than when aligned to achieve motion transverse to the actual heading of the vessel 10, such as along lines 31 and 32 in FIGS. 2-6. That is, vectoring of the propeller drives to achieve, for example, side directed forces (e.g. F1X, F2X shown in FIGS. 3 and 4) reduces the total available thrust in the actual direction of vessel movement. The vessel 10 and related propulsion units are most efficiently operated when the propulsion units are oriented in the direction of vessel travel, such as is shown in FIG. 6 with reference to lines 31' and 32'.

According to the station keeping functionality described above, a selected global position and a selected heading are maintained despite external forces acting on the vessel 10, such as wind, waves, etc. to move the vessel out of the selected global position and selected heading. The microprocessor 116 is programmed to rotate the propulsion devices 27, 28 about the steering axes 21, 22 to achieve a target linear thrust 130 and moment 132 (see FIGS. 12 and 13 and related description herein) that are necessary to counteract the external forces and thereby maintain both the vessel's initial global position and the vessel's initial heading. However because of the above-described differences in available thrust for different rotational positions of the propulsion devices 27, 28, the system's ability to successfully maintain position and heading of the vessel 10 will depend upon the orientation of the vessel 10 relative to the direction of the external forces. For example, if a large enough external force is applied to the side of the vessel 10, the propulsion devices 27, 28 may not be able to provide enough resultant linear thrust opposite the external force in the sideways direction 30 to counteract the external force. This is a disadvantage of the prior art that had been recognized by the inventors.

Figure 15:
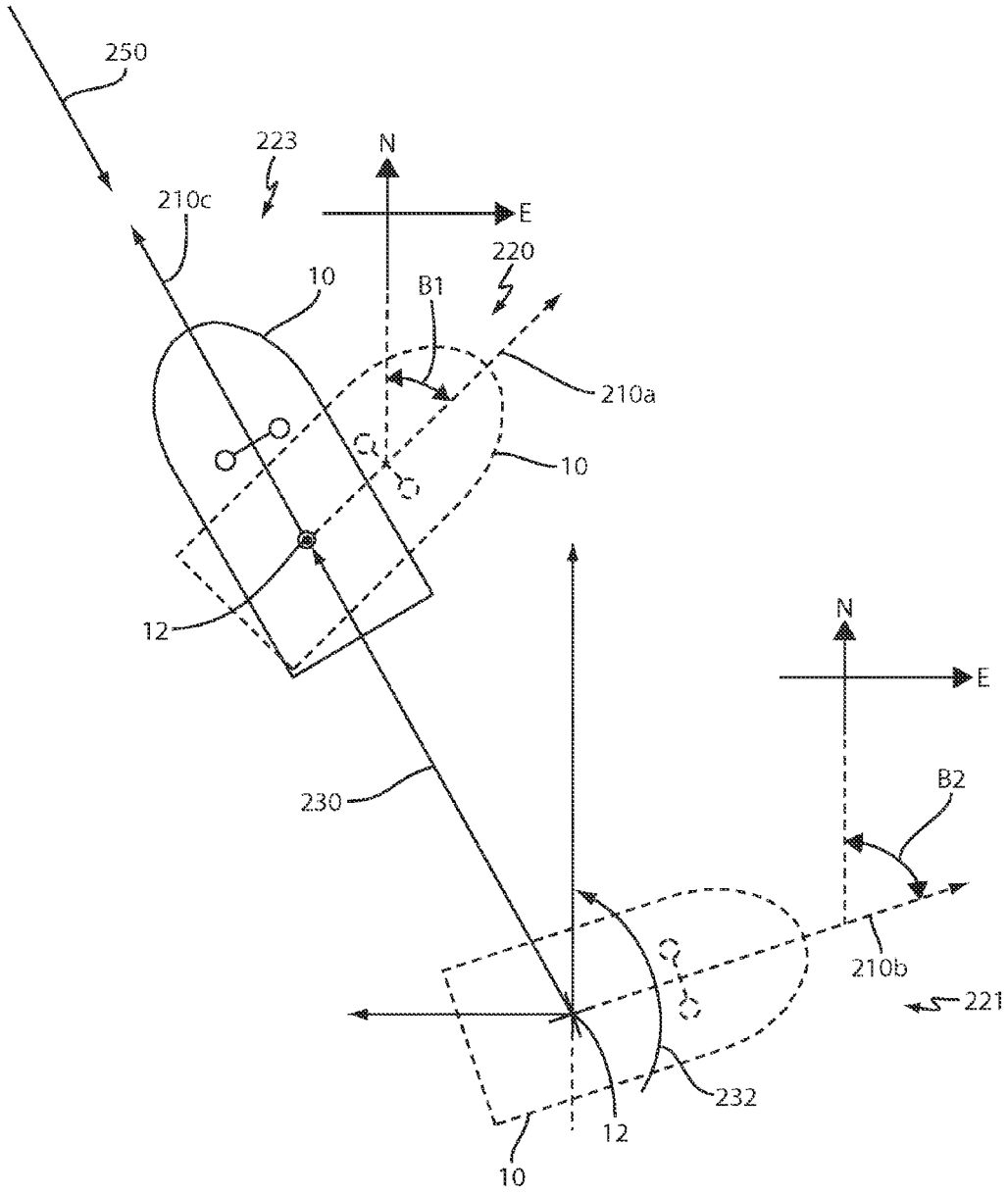
FIG. 15 is another representation of a marine vessel which has been moved from an initial position to a second position and subsequently been moved into a third position having a common global position with the initial position.

The present disclosure provides systems and methods to supplement the functional advantages of the station keeping systems and methods described above. FIG. 15 is a schematic illustration which shows a marine vessel 10 in three exemplary positions. An initial, or desired position 220 is shown in dashed line format and generally is identical to the position 120 described above in conjunction with FIGS. 12 and 13. The initial position 220 is defined by a global position (i.e. the longitude and latitude of the center of gravity 12) and a heading represented by vector 210*a* and angle B1. The initial position 220 is, for the purposes described herein, the global position and heading which the microprocessor 116 is programmed to maintain, in accordance with the station keeping features described above. A second position 221 is shown in dashed line format and is representative of the vessel 10 location after it has been moved away from the initial position 220 by external forces 250 such as wind, waves, etc. In the second position 221 the vessel 10 has rotated slightly in a clockwise direction so that its heading vector 210*b* is now defined by a larger angle B2 with respect to a due north vector.

According to the orienting procedures discussed above regarding FIGS. 1-14, the microprocessor 116 is configured to compare the initial position 220, including the associated global position 12 and heading 210*a* to the second position 221 to compute an error or difference therebetween and to control operations of the propulsion units 27, 28 to generate a target thrust vector 230 and target moment 232 suitable to move the marine vessel 10 back into the initial position 220. However contrary to the embodiments described above, the microprocessor 116 in the presently described embodiment is also configured to operate according to a "Thrust Maximization Mode" wherein the target moment 232 that is generated by vectoring of the propulsion devices 27, 28 causes the vessel 10 to continue to rotate about its center of gravity 12 until the actual heading 210*c* and the target thrust 230 are aligned. This is contrary to the above-described embodiments wherein the target moment 232 that is generated causes the vessel 10 to rotate back to its initial heading 210*a* in the initial position 220. Under "Thrust Maximization Mode", alignment of the actual heading 210*c* and the target thrust 230 allows for propulsion units 27, 28 to be aligned in a parallel to maximize the output of those units, such as along lines 31' and 32' shown in FIG. 6, to most effectively achieve the target thrust vector configuration 230. As described above regarding FIG. 6, in such parallel alignment, vectoring of the respective thrusts provided by the units 27, 28 is not necessary to achieve movement of the vessel 10 in the desired direction of the thrust vector 230.

A third or return position 223 is also shown, and is representative of the vessel 10 location after it has been moved back to the initial global position under the Thrust Maximization Mode. As can be seen in FIG. 15, the actual heading 210*c* of the vessel 10 in the return position 223 is aligned with the thrust vector 230 necessary to maintain the vessel 10 at the initial position 220. Although the return position 223 is depicted with the bow of the vessel 10 oriented in the direction of the actual heading 210*c*, the system could alternately be configured to rotate the vessel 10 such that the stern of the vessel 10 is directed to the counteracting force 250. That is, the vessel 10 could be rotated 180 degrees from the orientation shown in FIG. 15 about the center point 12. This type of an arrangement would also allow for alignment of the propulsion units 27, 28 in a parallel orientation to maximize output of those units.

The microprocessor 116 can be programmed to repeatedly perform the above steps to continue to maintain the vessel 10 at the initial position 220 with the actual heading 210*c* being continually realigned with the thrust vector 230, even when the thrust vector 230 changes in orientation due to changes in external forces on the vessel 10 such as wind, waves, current, tide, etc. As with the other station keeping features described herein above, the Thrust Maximization Mode can be turned on and off via a user input device such as 50 or 120, or alternately preprogrammed to automatically operate under certain vessel conditions, such as when the vessel 10 is not otherwise able to maintain a selected global position due to external forces.

Figure 16:
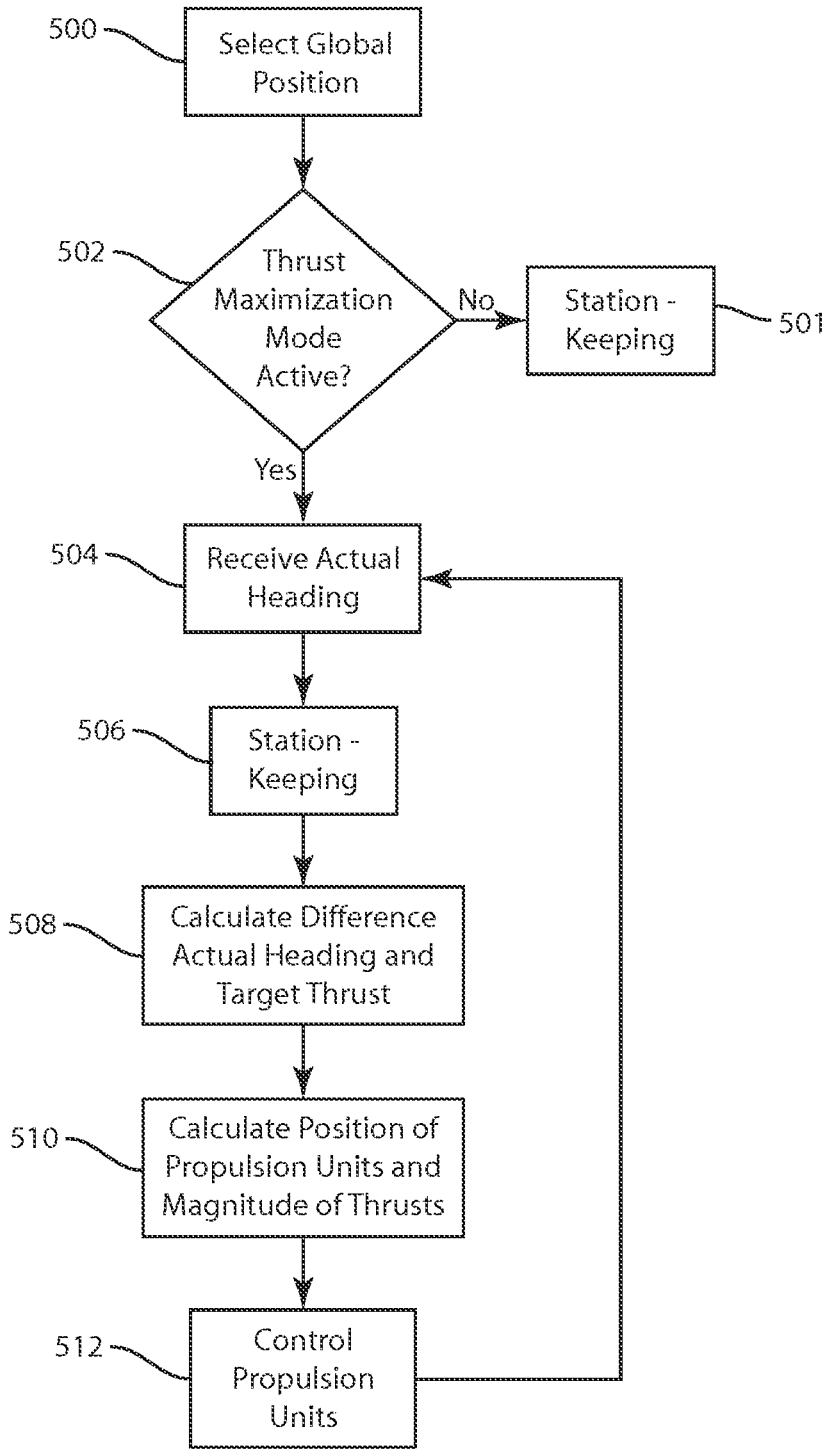
FIG. 16 is a flow chart illustrating one example of a method of orienting a marine vessel according to the present disclosure.

Referring to FIG. 16, exemplary method steps for maintaining the global position of the vessel (i.e. position with respect to latitude and longitude) despite counteracting forces such as wind, waves, current, etc. are described. In this example, the vessel's actual heading is determined and then actively changed while the vessel's global position is maintained constant, so as to provide increased available thrust to counteract external forces acting on the vessel in accordance with the discussion above. At step 500, the operator identifies or selects a global position in which it is desired to maintain the marine vessel. This can be accomplished via, for example, operation of the input device 50 or 120, as described above with reference to FIGS. 1-14. At step 502, the microprocessor determines whether or not a "Thrust Maximization Mode" is active. If no, the microprocessor 116 at step 501 will follow the steps described above for station keeping, without thrust maximization. If yes, the microprocessor 116 will continue to process the next steps in the method. At step 504, the microprocessor 116 receives input identifying the actual heading of the vessel from, for example, the GPS devices 101, 102 and the IMU 106. At step 506, the microprocessor 116 operates according to the station keeping methods described above in reference to FIGS. 1-14 to achieve and maintain the selected position (latitude and longitude) of the vessel. Simultaneously or subsequently, at step 508, the microprocessor 116 calculates the difference between the actual heading of the vessel and the target linear thrust necessary to achieve or maintain the selected global position. At step 510, the microprocessor 116 calculates the necessary rotational positions of the propulsion units and magnitudes of thrust outputted by the propulsion units to create a moment that will cause the vessel to rotate about its center of gravity 12 until the difference between the actual heading of the vessel and the target linear thrust currently necessary to maintain the vessel in the selected global position is zero. At step 512, the microprocessor 116 controls operation of the first and second propulsion devices to achieve the necessary moment to causes the actual heading of the vessel to become aligned with the thrust vector. The above referenced steps can be continuously repeated to actively maintain the alignment between the actual heading and thrust vector necessary to maintain the selected global position.

Thrust Maximization Mode can for example be activated by the user via for example the input device 120 or by a button on the joystick 50. Alternately, Thrust Maximization Mode can be programmed into the microprocessor 116 to remain active during operation of station keeping functions. In another example, Thrust Maximization Mode can be automatically activated by the microprocessor 116 only when the microprocessor 116 determines that it is not possible to maintain a selected heading and global position because of counteracting forces (e.g. wind, waves, current) on the vessel. For example if the counteracting forces are larger than the available thrust, it would not be possible to maintain the selected global position and/or heading. If this is the case, the microprocessor 116 will initiate Thrust Maximization Mode. If this is not the case, the microprocessor 116 will instead follow the steps described above for station keeping, without thrust maximization.

Figure 17:
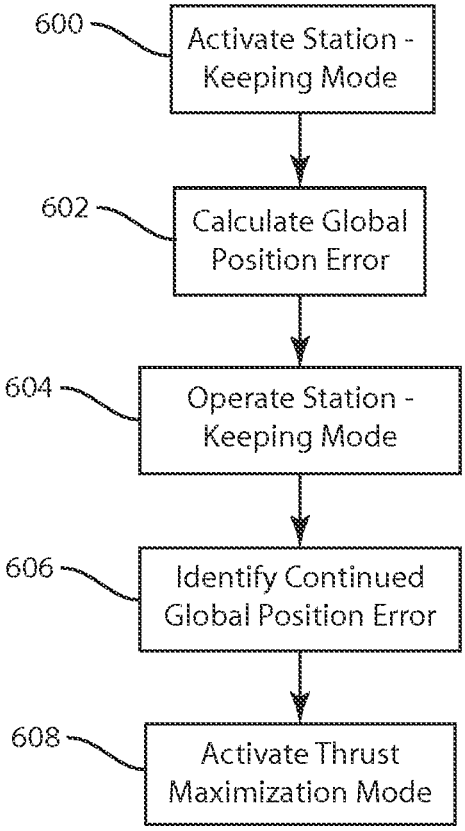
FIG. 17 is a flow chart illustrating another example of a method of orienting a marine vessel according to the present disclosure.

Referring to FIG. 17, exemplary method steps are now described for automatically initiating Thrust Maximization Mode only when the microprocessor 116 determines that it is not possible to maintain a selected heading and global position because of counteracting forces on the vessel. In this example, the station keeping mode discussed above regarding FIGS. 1-14 is activated at step 600. At step 602, the microprocessor 116 calculates a global position error according to the steps discussed above regarding FIG. 14. Briefly, the IMU 106 periodically obtains new data from the GPS devices 101 and 102 and provides the position information to an error calculator 144 within microprocessor 116. This error calculator compares the target global position and target heading to current values of these two variables. That produces a difference magnitude which is defined in terms of a north-south difference and an east-west difference in combination with a heading angular difference. These values are graphically represented as the target linear thrust 130 and the target moment 132. The target linear thrust 130 is the net difference in the longitude and latitude positions represented by the target position and current position. The heading difference is the angular difference between angles A2 and A1 in FIG. 13. This information, which is described in terms of global measurements and which are in reference to stationary global references, are provided to an error calculator 148 which resolves those values in forward-reverse, left-right, and heading changes in reference to clockwise and counterclockwise movement of the marine vessel 10. These errors are provided to a PID controller 150, which uses proportional, integral, and derivative techniques to maintain a measured variable at a preselected set point, as discussed above and is used in the maneuvering algorithm 154 described above.

At step 604, the station keeping mode is operated in conformance with the methods provided above to move the vessel back into its initial position.

At step 606, the microprocessor 116 identifies a continued global position error which, after a predetermined number of attempts by the controller 116, cannot be resolved. For example, when operation of the propulsion units 27, 28 is insufficient to move the vessel back to its initial position. If this happens, at step 608, the microprocessor 116 is programmed to activate the Thrust Maximization Mode to enhance available thrust in accordance with the principles discussed above.

The invention claimed is:

1. A system for orienting a marine vessel, comprising:

a plurality of marine propulsion devices for orienting the marine vessel;

a control device having a memory and a programmable circuit, the control device programmed to control operation of the plurality of marine propulsion devices to maintain orientation of the marine vessel in a selected global position;

wherein the control device is programmed to calculate a direction of a resultant thrust vector associated with the plurality of marine propulsion devices that is necessary to maintain the vessel in the selected global position;

wherein the control device is programmed to control operation of the plurality of marine propulsion devices to change the actual heading of the marine vessel to align the actual heading with the thrust vector; and a user input device that provides the control device with a signal that is representative of an operator desired movement;

wherein in a first mode the control device is programmed not to control operation of the marine propulsion devices to change the actual heading of the marine vessel to align the thrust vector with the actual heading and in a second mode the control device is programmed to control operation of the plurality of marine propulsion devices to change the actual heading of the marine vessel to align the thrust vector and the actual heading;

wherein in both of the first and second modes the control device is configured to control operation of the marine propulsion devices to maintain the selected global position of the marine vessel; and wherein the control device is configured to determine, with a global position sensor, that the first mode is unable to maintain the global position of the marine vessel and thereafter to automatically activate the second mode.

2. The system according to claim 1, wherein in the second mode the control device is programmed to actively maintain the actual heading of the marine vessel in alignment with the thrust vector by repeatedly calculating the direction of the thrust vector and changing the actual heading of the marine vessel to align with the thrust vector.

3. The system according to claim 1, wherein in the second mode, when the actual heading and the thrust vector are not aligned, the control device is programmed to control operation of the plurality of marine propulsion devices to create a moment arm that causes rotation of the marine vessel about its center of gravity to thereby align the actual heading with the thrust vector.

4. The system according to claim 1, wherein in the second mode, the control device is programmed to calculate a rotational position of each propulsion unit in the plurality of propulsion units, and a respective magnitude of thrust output by each propulsion unit in the plurality of propulsion units that are necessary to cause the marine vessel to rotate until the actual heading of the marine vessel and the thrust vector are aligned.

5. The system according to claim 1, wherein the user input device is configured to allow an operator to select between the first and second modes.

6. The system according to claim 5, wherein the user input device comprises a joystick.

7. The system according to claim 5, comprising a compass device that provides a signal representative of actual heading of the marine vessel to the control device.

8. The system according to claim 5, wherein the actual heading is the longitudinal direction in which a bow of the vessel is directed.

9. The system according to claim 5, wherein aligning thrust vector and the actual heading causes an output thrust of each of the plurality of marine propulsion devices to be aligned with the actual heading.

10. The system according to claim 5, wherein the plurality of marine propulsion devices comprises first and second marine propulsion devices.

11. A method for orienting a marine vessel, comprising:

providing a plurality of marine propulsion devices coupled to the marine vessel;

selecting a global position of the marine vessel;

determining an actual heading of the marine vessel in the global position;

providing a control device having a memory and a programmable circuit, wherein the control device controls operation of the plurality of marine propulsion devices in first and second modes;

operating the control device in the second mode to (a) control operation of the plurality of marine propulsion devices to maintain the global position of the marine vessel;

(b) calculate a direction of a thrust vector associated with the plurality of marine propulsion devices, which is necessary to maintain the global position of the marine vessel; and (c) control operation of the plurality of marine propulsion devices to change the actual heading of the marine vessel to align the direction of the thrust vector and the actual heading;

selecting between the first and second modes of operation wherein in the second mode the control device controls operation of the plurality of marine propulsion devices to change the actual heading of the marine vessel to align the thrust vector and the actual heading and in the first mode the control device does not control operation of the plurality of marine propulsion devices to change the actual heading of the marine vessel to align the thrust vector and the actual heading;

controlling operation of the marine propulsion devices in both of the first and second modes to maintain the selected global position of the marine vessel; and determining with a global position sensor that the control device in the first mode is unable to maintain the global position of the marine vessel and thereafter automatically activating the second mode.

12. The method according to claim 11, comprising, in the second mode, controlling operation of the plurality of marine propulsion devices to create a moment arm that causes rotation of the marine vessel about its center of gravity to thereby align the actual heading with the thrust vector.

* * * * *